US007604299B2

(12) United States Patent
Su

(10) Patent No.: US 7,604,299 B2
(45) Date of Patent: Oct. 20, 2009

(54) BACKREST ASSEMBLY

(76) Inventor: Tung-Hua Su, No. 6, Sec. 3, Bao Ta Road, Kuwi Jen Hsiang, Tainan Hsien (TW) 711

( * ) Notice: Subject to any disclaimer, the term of this patent is extended or adjusted under 35 U.S.C. 154(b) by 179 days.

(21) Appl. No.: 11/953,049

(22) Filed: Dec. 8, 2007

(65) Prior Publication Data

US 2009/0146482 A1 Jun. 11, 2009

(51) Int. Cl.
*A47C 7/02* (2006.01)

(52) U.S. Cl. ..... 297/452.18; 297/452.29

(58) Field of Classification Search ..... 297/452.18, 297/452.21, 452.22, 452.29, 452.33, 452.34, 297/452.36

See application file for complete search history.

(56) References Cited

U.S. PATENT DOCUMENTS 5,338,099 A * 8/1994 Ishi et al. ..... 297/452.33
5,951,110 A * 9/1999 Conner et al. ..... 297/452.31
6,626,497 B2 * 9/2003 Nagamitsu et al. ..... 297/452.15
2008/0067852 A1 * 3/2008 Nordstrom et al. ..... 297/452.36
2008/0157580 A1 * 7/2008 Lin ..... 297/391
2008/0284229 A1 * 11/2008 Masunaga et al. ..... 297/452.18

* cited by examiner

*Primary Examiner*—Sarah B McPartlin
(74) *Attorney, Agent, or Firm*—Banger Shia

(57) ABSTRACT

A backrest assembly includes a rigid frame having an annular body. A connecting plate is interconnected between left and right sides of the annular body above a bottom side of the annular body. A plurality of supporting plates are interconnected between the connecting plate and the bottom side of the annular body. The annular body further includes a ridge extending radially outward from an outer peripheral face thereof and spaced from a front end face of the annular body, forming a ledge between the front end face and the ridge. A flexible board includes a flange formed on a rear side thereof. The flange is mounted around the ledge and abuts against the ridge. The board further includes a plurality of vents extending from a front side thereof through a rear side thereof. Fasteners are extended through engaging holes in the ridge into fixing holes of the board.

6 Claims, 9 Drawing Sheets

BACKREST ASSEMBLY

BACKGROUND OF THE INVENTION

1. Field of the Invention

The present invention relates to a backrest assembly and, more particularly, to a back assembly that is reliable, supportive, flexible, air-permeable, comfortable, and easy to recycle.

2. Description of the Related Art

A backrest provides a support for a back of a user. Conventional backrests include a board that can be made of various rigid materials such as woods, rigid plastics, and metal. However, the user feels uncomfortable at the back contacting the hard board. To provide comfort, the board is provided with soft padding such as foam covered by cloth or leather. However, the costs are expensive, and the padding is often not permeable to air, resulting in heat and discomfort. Furthermore, the padding is generally fixed to the board and, thus, can not be replaced when desired. Furthermore, detachment of the backrest is difficult after it has been used for a period of time and, thus, should be discarded. Namely, recycling of the components of the backrest is a difficult job.

BRIEF SUMMARY OF THE INVENTION

An objective of the present invention is to provide a backrest assembly that is reliable, supportive, flexible, air-permeable, comfortable, and easy to recycle and that has wider application.

A backrest assembly according to the preferred teachings of the present invention includes a frame made of rigid material and having an annular body. The annular body includes an opening extending from a front side thereof through a rear side thereof. The annular body further includes left and right sides and a bottom side. A connecting plate is interconnected between the left and right sides of the annular body above the bottom side and delimits the opening. A plurality of supporting plates are interconnected between the connecting plate and the bottom side of the annular body. The frame further includes a seat connecting section below supporting plates and adapted to connect with a seat of a chair. The annular body further includes a ridge extending radially outward from an outer peripheral face thereof and spaced from a front end face of the annular body, forming a ledge between the front end face and the ridge of the annular body. The ridge includes a plurality of engaging holes. A board made of flexible material includes a flange formed on a rear side thereof. The flange is mounted around the ledge of the annular body and abuts against the ridge of the frame. The board further includes a plurality of fixing holes aligned with the fixing holes of the annular ridge. The board further includes a plurality of vents extending from a front side thereof through a rear side thereof. A plurality of fasteners are extended through the engaging holes of the ridge into the fixing holes of the board.

Preferably, the flange of the board and the ridge of the annular body are annular.

Preferably, the annular body further includes an annular flange extending rearward and radially inward from the front end face thereof. The annular flange of the annular body includes a distal end spaced from an inner periphery of the annular body.

Preferably, each supporting plate has a spacing from the front end face of the annular body in a horizontal direction perpendicular to a vertical plane. The supporting plates extend downward and connect with the seat coupling section.

Preferably, each supporting plate has a thickness in a longitudinal direction perpendicular to an extending direction of the bottom side of the annular body. Each supporting plate further has a width in the direction parallel to the extending direction of the bottom side of the annular body, with the thickness being greater than the width.

Preferably, the board further includes a transverse hole in an intermediate portion thereof. The board further includes left and right sides. The transverse hole extends from the front side through the rear side of the board and extends in a widthwise direction of the board between the left and right sides of the board. The transverse hole is located between and spaced from the left and right sides of the board. The board further includes upper and lower extensions extending upward and downward from each of two ends of the transverse hole, forming upper and lower flexible sections on upper and lower sides of the transverse hole. The upper and lower flexible sections are flexible about a longitudinal axis of the transverse hole.

The present invention will become clearer in light of the following detailed description of an illustrative embodiment of this invention described in connection with the drawings.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
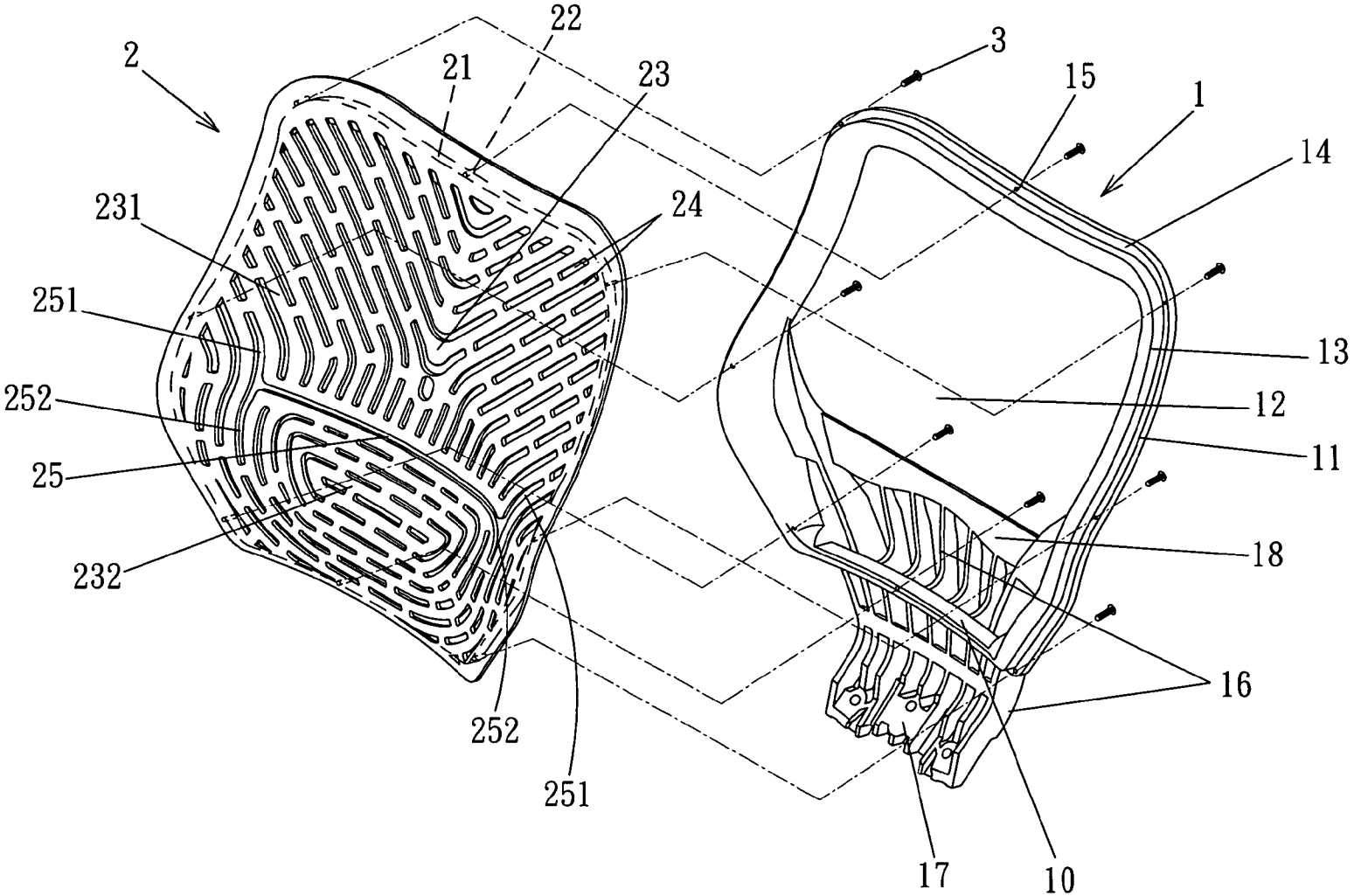
FIG. 1 shows a front, exploded, perspective view of a backrest assembly according to the preferred teachings of the present invention.
Figure 2:
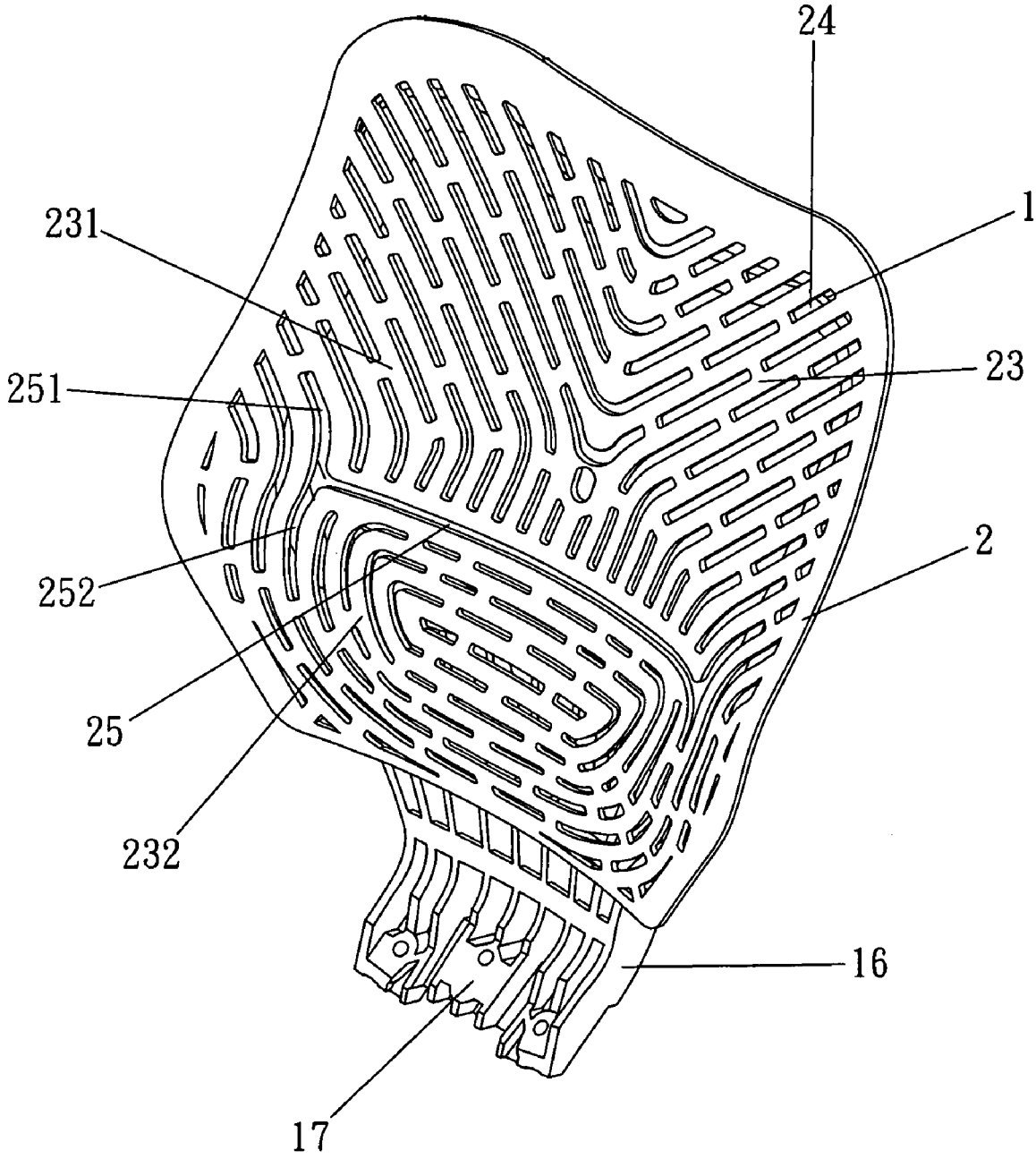
FIG. 2 shows a front, perspective view of the backrest assembly of FIG. 1.
Figure 3:
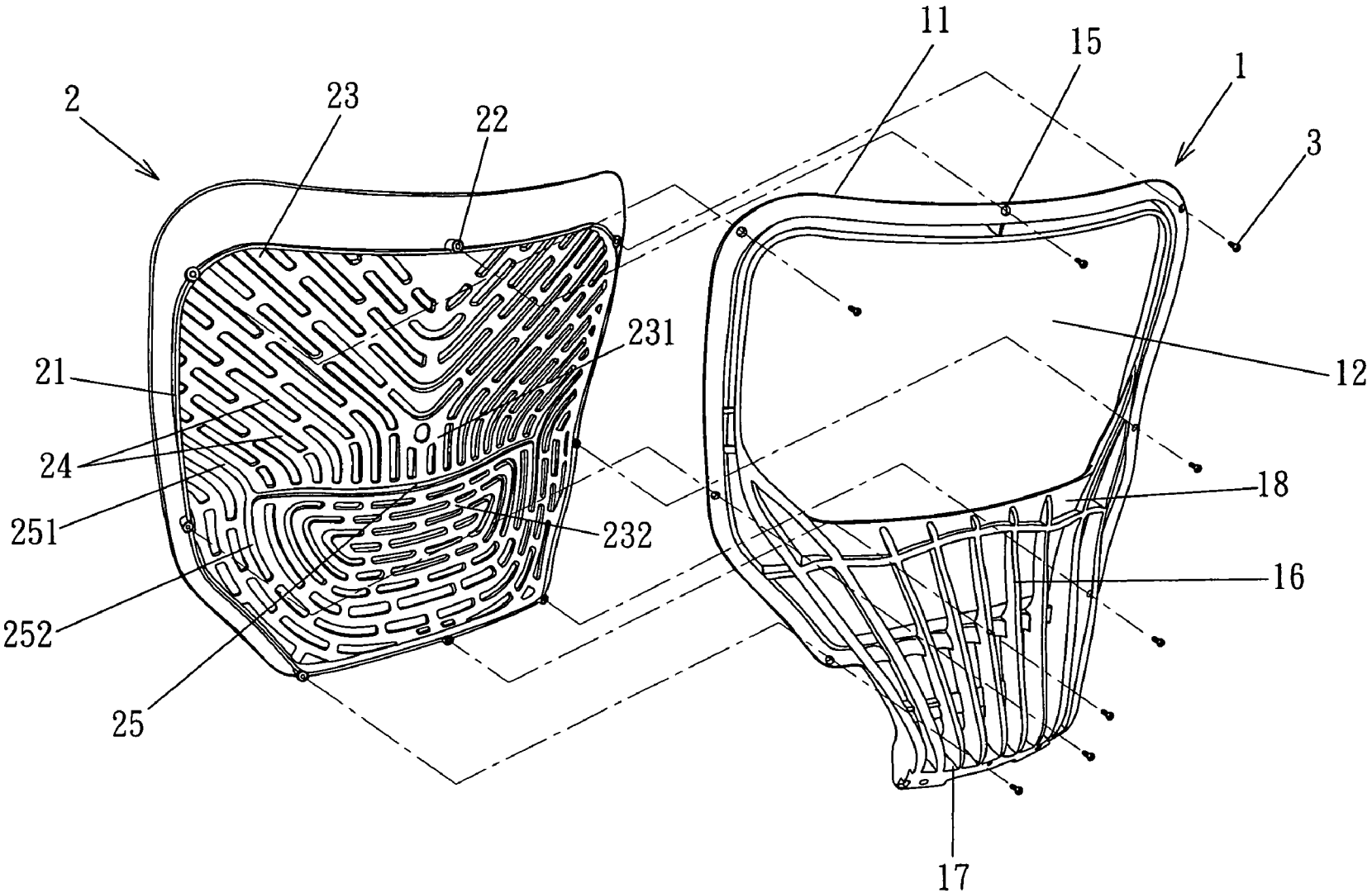
FIG. 3 shows a rear, exploded, perspective view of the backrest assembly of FIG. 2.
Figure 4:
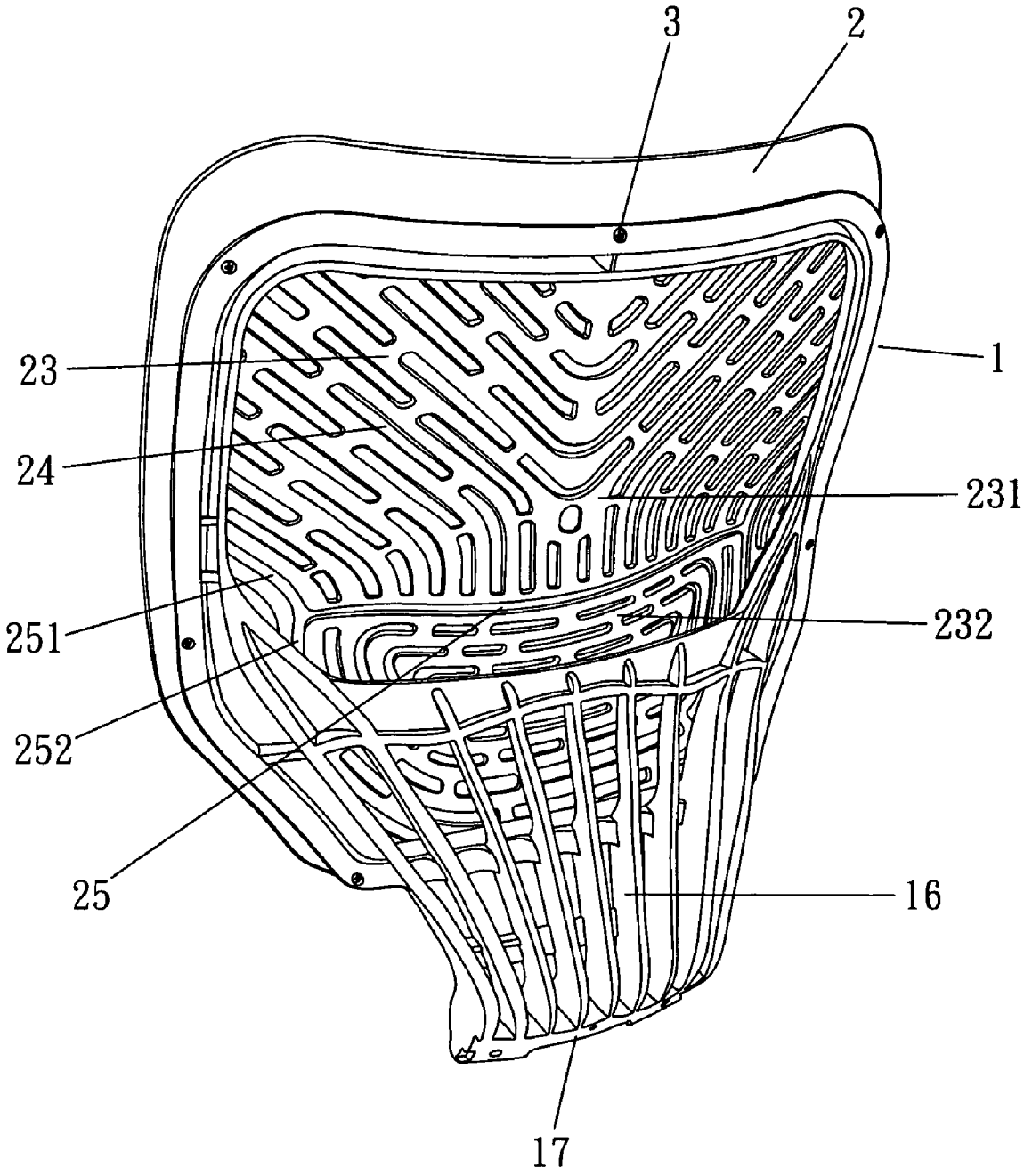
FIG. 4 shows a rear perspective view of the backrest assembly of FIG. 2.
Figure 5:
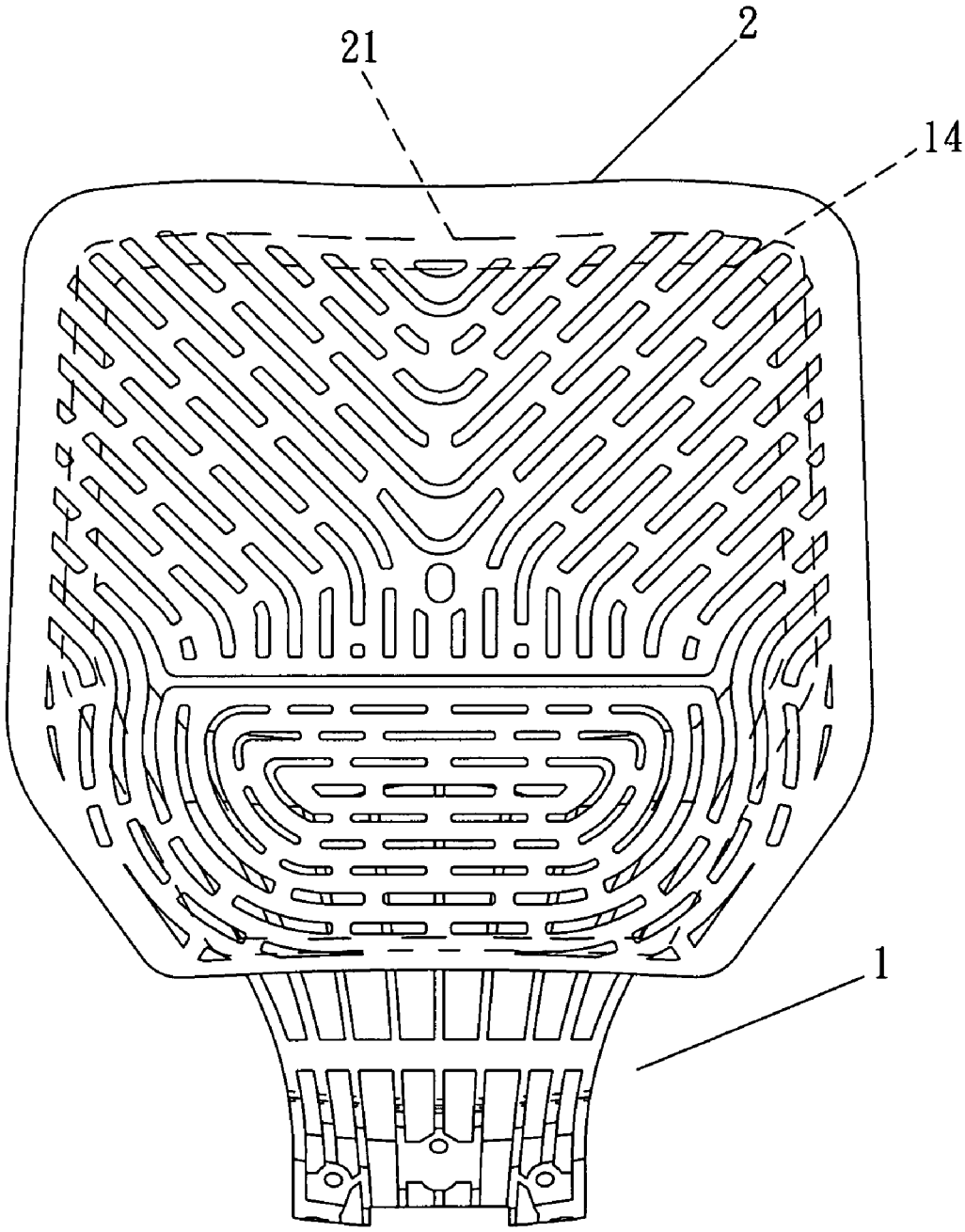
FIG. 5 shows a front elevational view of the backrest assembly of FIG. 2.
Figure 6:
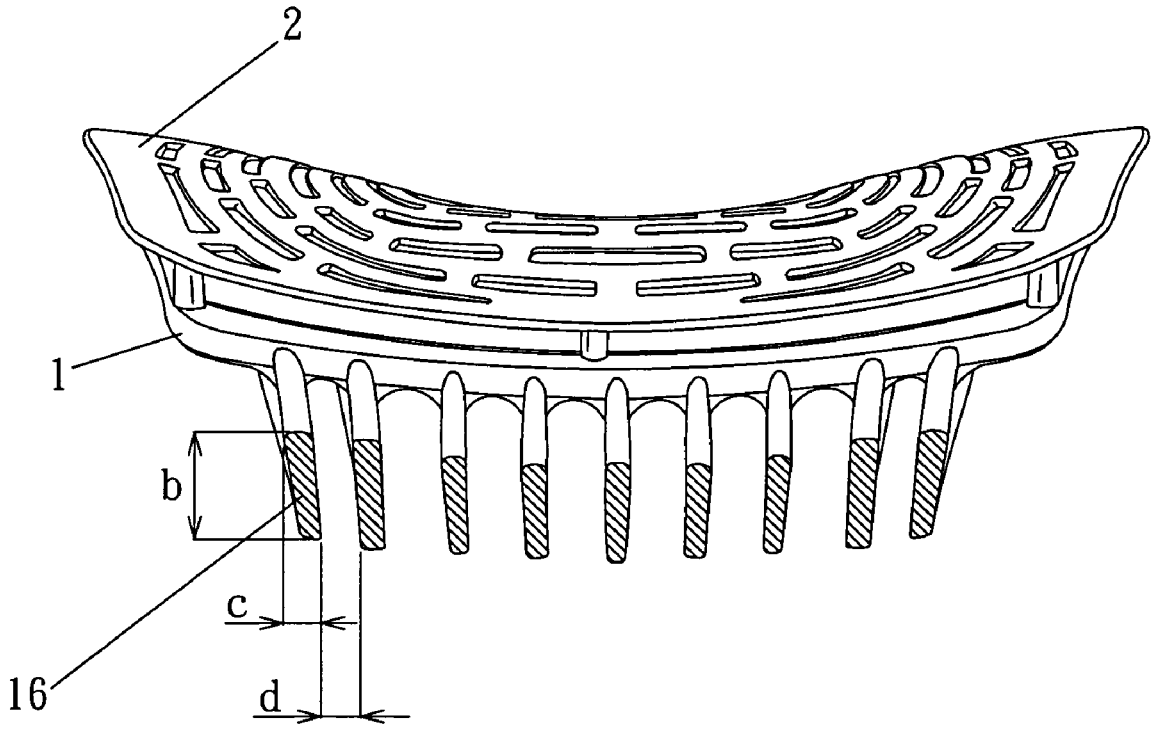
FIG. 6 shows a cross sectional view of the backrest of FIG. 2.
Figures 7, 7A, 7B:
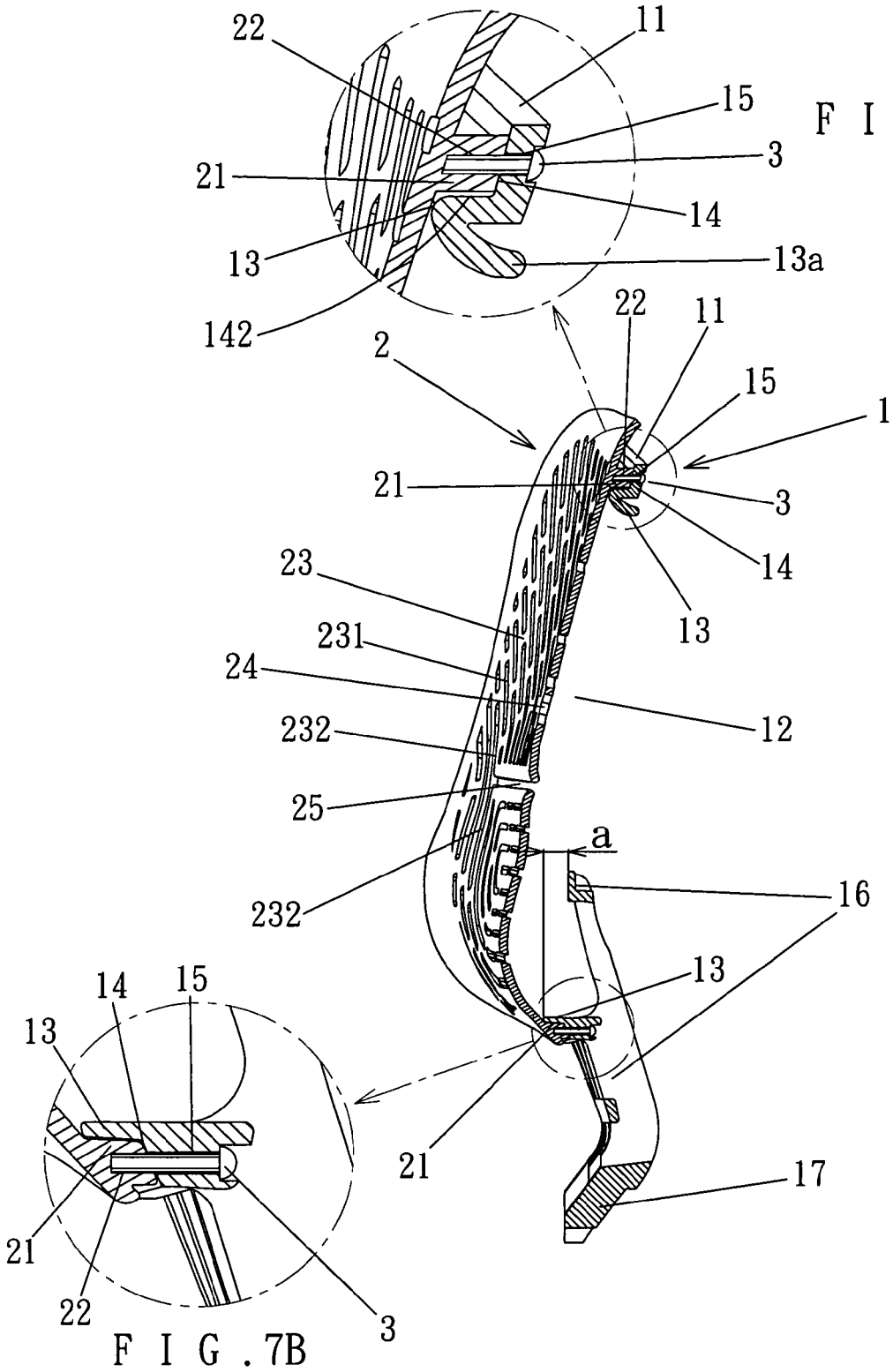
FIG. 7 shows another cross sectional view of the backrest assembly of FIG. 2.
FIG. 7A shows an enlarged view of an upper circled portion in FIG. 7.
FIG. 7B shows an enlarged view of a lower circled portion in FIG. 7.

A backrest assembly according to the preferred teachings of the present invention is shown in the drawings and generally includes a frame 1 and a board 2. The frame 1 is made of rigid material such as rigid plastics or metal to provide higher supporting strength. The frame 1 includes an annular body 11 having an opening 12 extending from a front side through a rear side thereof. The annular body 11 includes a flange 13 extending rearward and radially inward from a front end face thereof. The flange 13 has a distal edge 13*a* (FIG. 7A) spaced from an inner periphery of the annular body 11. The annular body 11 further includes an annular ridge 14 extending radially outward from an outer peripheral face thereof and spaced from the front end face, forming a ledge 142 between the front end face and the annular ridge 14 of the annular body 11. The annular ridge 14 includes a plurality of engaging holes 15. A connecting plate 18 is interconnected between left and right sides of the annular body 1 and delimits the opening 12. A plurality of supporting plates 16 extend between the connecting plate 18 and a bottom side 10 of the annular body 11 below the connecting plate 18. Each supporting plate 16 is spaced from the front end face of the annular body 11 by a spacing a in a horizontal direction perpendicular to a vertical plane (FIG. 7). A pair of supporting plates 16 adjacent to each other is spaced from each other by a spacing d in a direction parallel to an extending direction of the bottom side 10 of the annular body 11 to provide enhanced torque capacity for preventing deformation of the annular body 11. Each supporting rod 16 extends further downward to connect with a seat connecting section 17 to which a seat 19 (FIG. 8) of a chair is attached. Each supporting plate 16 has a thickness b (FIG. 6) in a longitudinal direction perpendicular to the vertical direction and perpendicular to the extending direction of the lower section of the annular body 11. Each supporting plate 16 further has a width c (FIG. 6) in the direction parallel to the extending direction of the bottom side 10 of the annular body 11, with the thickness b being greater than the width c to provide enhanced supporting strength.

According to the preferred form shown, the board 2 is made of flexible plastic material. The board 2 includes an annular flange 21 on a rear side thereof. A plurality of fixing holes 22 are defined in the rear side of the board 2. The board 2 further includes a plurality of vents 24 extending from the rear side through a front side 23 thereof. Furthermore, the board 2 further includes a transverse hole 25 in an intermediate portion thereof. The transverse hole 25 extends from the front side 23 through the rear side of the board 2 and extends in a widthwise direction of the board 2 between the left and right sides of the board 2. Furthermore, the transverse hole 25 is located between and spaced from left and right sides of the board 2. Furthermore, upper and lower extensions 251 and 252 extend upward and downward from each of two ends of the transverse hole 25, forming upper and lower flexible sections 231 and 232 on upper and lower sides of the transverse hole 25. Specifically, the upper and lower sections 231 are flexible about a longitudinal axis of the transverse hole 25.

In assembly, the board 2 is mounted to the front side of the frame 1, with the annular flange 21 of the board 2 mounted around the ledge 142 of the annular body 11 to prevent undesired displacement of the board 2 (FIG. 7A). It can be appreciated that the engaging holes 15 of the frame 1 are aligned with the fixing holes 22 of the board 2. Fasteners 3 are extended through the engaging holes 15 of the frame 1 into the fixing holes 22 of the board 2 (FIG. 7B). It can be appreciated that the annular flange 21 of the board 2 abuts against a front face of the annular ridge 14 of the frame 1 (FIG. 7A).

Figure 8:
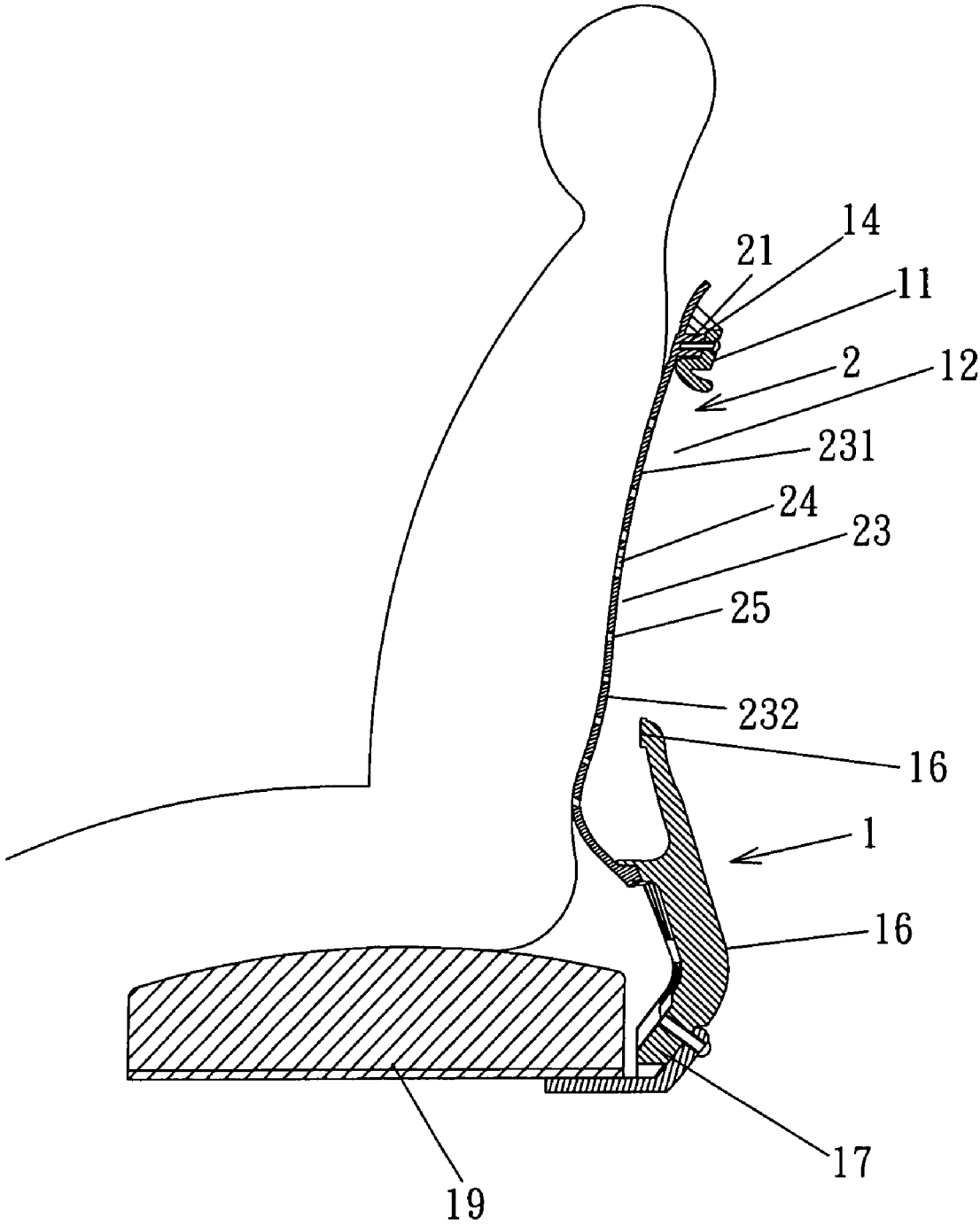
FIG. 8 shows a cross sectional view of the backrest assembly of FIG. 2 and a seat attached to a lower end of the backrest assembly, illustrating use of the backrest assembly.

With reference to FIG. 8, when a user lies against the board 2, the board 2 provides appropriate support. Furthermore, the lying force applied to the board 2 can imparted to the frame 1, for the annular flange 21 of the board 2 presses against the annular ridge 14 of the frame 1. Thus, the frame 1 provides stable support. It can be appreciated that the supporting plates 16 of the frame 1 provides enhanced structural strength to prevent deformation of the frame 1. Disengagement of the board 2 from the frame 1 is avoided even after a long period of time of usage. The life of the backrest is prolonged.

It can be appreciated that the upper and lower flexible sections 231 and 232 flex about the longitudinal axis f the transverse hole 25 in the intermediate portion of the board 2 when the user lies against the front side 23 of the board 2. Since the supporting plates 16 are spaced from the front side of the frame 1 and from the front side 23 of the board 2, the board 2 is prevented from pressing against the supporting plates 16 when the board 2 flexes. Thus, movement of the upper and lower flexible sections 231 and 232 is not hindered. It can be further appreciated that the vents 24 of the board 2 improves lying comfort by providing air permeability.

When the backrest according to the preferred teachings of the present invention is to be discarded after long-term use, the fasteners 3 can be removed, and the frame 1 and the board 2 can be detached. Since each of the frame 1 and the board 2 is made of a single material, they can be easily recycled and reused.

Figure 9:
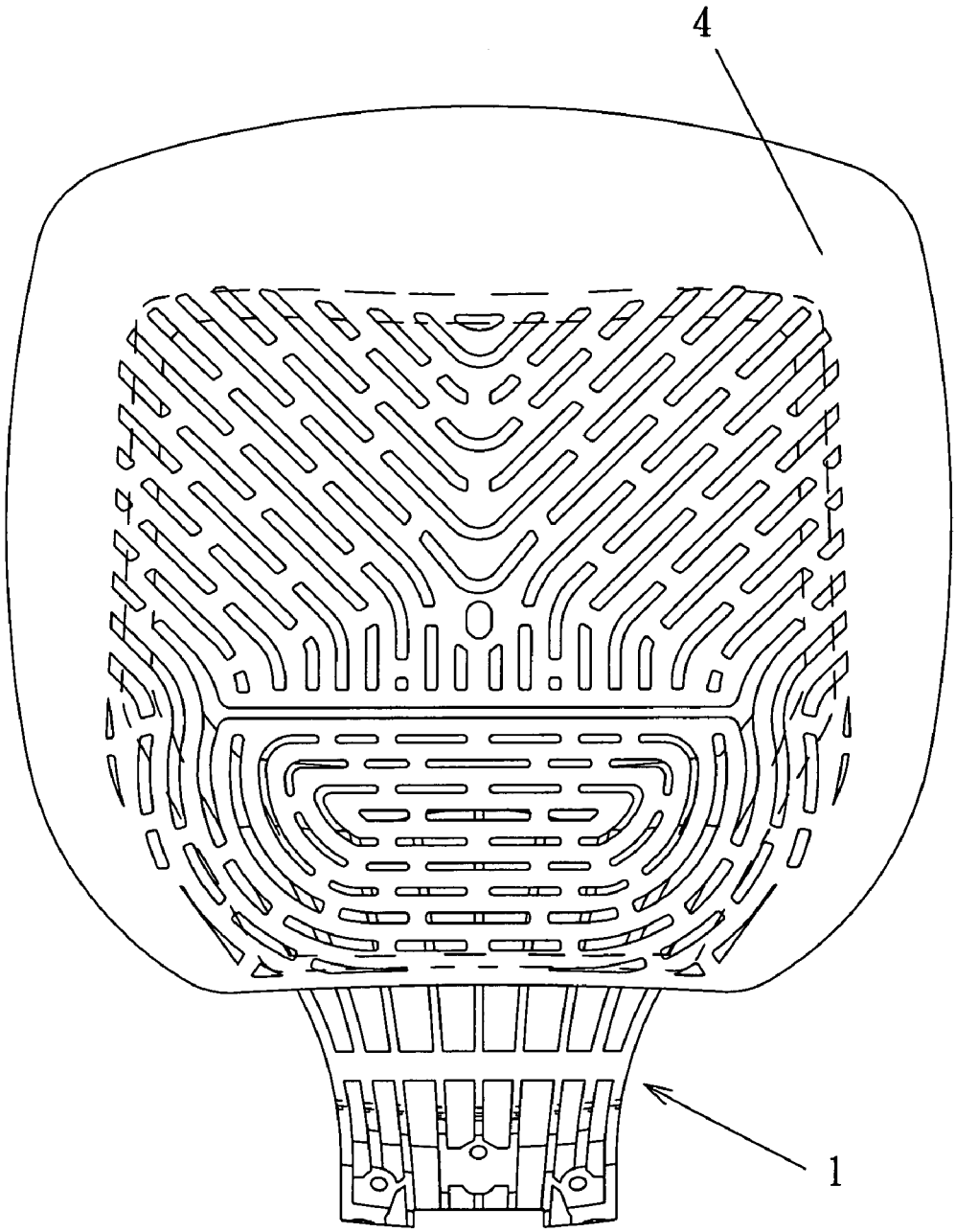
FIG. 9 shows a front elevational view of a backrest of a modified embodiment according to the preferred teachings of the present invention.

With reference to FIG. 9, the frame 1 can be utilized with a board 4 with a different shape and a different size. The board 4 shown in FIG. 9 has an area larger than that of the board 2 shown in FIGS. 1-8 and, thus, provides a larger area for the user to lie against.

The backrest assembly according to the preferred teachings of the present invention is reliable, supportive, flexible, air-permeable, comfortable, and easy to recycle and has wider application than conventional ones. Since the board 2 and the frame 1 are assembled in which the annular flange 21 of the board 2 is mounted around the flange 13 of the frame 1 and abuts against the annular ridge 14 of the frame 1, undesired displacement between the board 2 and the frame 1 will not occur. The annular flange 21 of the board 2 can be spaced from the flange 13 of the frame 1 and annularly arranged.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A backrest assembly comprising:

a frame made of rigid material and including an annular body, with the annular body including an opening extending from a front side thereof through a rear side thereof, with the annular body further including left and right sides and a bottom side, with a connecting plate being interconnected between the left and right sides of the annular body above the bottom side and delimiting the opening, with a plurality of supporting plates being interconnected between the connecting plate and the bottom side of the annular body, with the frame further including a seat connecting section below the plurality of supporting plates and adapted to connect with a seat of a chair, with the annular body further including a ridge extending radially outward from an outer peripheral face thereof and spaced from a front end face of the annular body, forming a ledge between the front end face and the ridge of the annular body, with the ridge including a plurality of engaging holes;

a board made of flexible material, with the board including a flange formed on a rear side thereof, with the flange being mounted around the ledge of the annular body and abutting against the ridge of the frame, with the board further including a plurality of fixing holes aligned with the fixing holes of the annular ridge, with the board further including a plurality of vents extending from a front side thereof through a rear side thereof; and a plurality of fasteners extending through the engaging holes of the ridge into the fixing holes of the board.

2. The backrest assembly as claimed in claim 1, with the flange of the board and the ridge of the annular body being annular.

3. The backrest assembly as claimed in claim 2, with the annular body further including an annular flange extending rearward and radially inward from the front end face thereof, and with the annular flange of the annular body including a distal end spaced from an inner periphery of the annular body.

4. The backrest assembly as claimed in claim 1, with each of the plurality of supporting plates having a spacing from the front end face of the annular body in a horizontal direction perpendicular to a vertical plane, and with the plurality of supporting plates extending downward and connecting with the seat connecting section.

5. The backrest assembly as claimed in claim 4, with each of the plurality of supporting plates having a thickness in a longitudinal direction perpendicular to an extending direction of the bottom side of the annular body, with each of the plurality of supporting plates further having a width in a direction parallel to the extending direction of the bottom side of the annular body, and with the thickness being greater than the width.

6. The backrest assembly as claimed in claim 1, with the board further including a transverse hole in an intermediate portion thereof, with the board further including left and right sides, with the transverse hole extending from the front side through the rear side of the board and extending in a widthwise direction of the board between the left and right sides of the board, with the transverse hole being located between and spaced from the left and right sides of the board, with the board further including upper and lower extensions extending upward and downward from each of two ends of the transverse hole, forming upper and lower flexible sections on upper and lower sides of the transverse hole, and with the upper and lower flexible sections being flexible about a longitudinal axis of the transverse hole.

* * * * *